United States Patent [19]

Hofmann

[11] 4,319,449

[45] Mar. 16, 1982

[54] OPEN END SPINNING ROTOR COMPRISING A MAIN BODY AND A ROTOR BODY

[75] Inventor: Eberhard Hofmann, Ingolstadt, Fed. Rep. of Germany

[73] Assignee: Schubert & Salzer, Ingolstadt, Fed. Rep. of Germany

[21] Appl. No.: 188,217

[22] Filed: Sep. 17, 1980

[30] Foreign Application Priority Data

Sep. 28, 1979 [DE] Fed. Rep. of Germany ..... 2939326

[51] Int. Cl.[3] ..... D01H 1/12

[52] U.S. Cl. ..... 57/58.89

[58] Field of Search ..... 57/58.89

[56] References Cited

U.S. PATENT DOCUMENTS 3,439,487 4/1969 Landwehrkamp et al. ..... 57/58.89
3,796,034 3/1974 Grau ..... 57/58.89 X
3,943,691 3/1976 Mizon et al. ..... 57/58.89
4,016,713 4/1977 Laüger et al. ..... 57/58.89 X
4,179,874 12/1979 Jacobsen ..... 57/58.89

FOREIGN PATENT DOCUMENTS 2358479 3/1978 France ..... 57/58.89

*Primary Examiner*—Donald Watkins
*Attorney, Agent, or Firm*—Bailey, Dority & Flint

[57] ABSTRACT

The main body (7) of an open end spinning rotor (3) which comprises a main body (7) and a rotor body (6) wherein the main body is carried by a mounting and drive element and has a substantially radial support surface (72) with a centering surface (70) at its outer edge. A centering surface (61) of the rotor body (6) co-operates with the centering surface 70 of the main body. The centering surfaces (70, 61) in the main body (7) and in the rotor body (6) are in the form of a peripheral groove and a peripheral rib, respectively. The support surface (72) and the centering surfaces (70) of the main body (7) have substantially radial slots (71).

10 Claims, 5 Drawing Figures

OPEN END SPINNING ROTOR COMPRISING A MAIN BODY AND A ROTOR BODY

BACKGROUND OF THE INVENTION

The present invention concerns an open end spinning rotor which comprises a main body and a rotor body. The main body is carried by a mounting and drive element and has a substantially radial support surface with a centering surface at its outer edge. A centering surface of the rotor body co-operates with the centering surface of the main body. The rotor body has a collecting surface and an open edge at the end which is remote from its centering surface.

The part of the spinning rotor which comes into contact with the fibers to be spun is subjected to a considerable amount of wear so that replacement of the spinning rotor is required after a certain number of operating hours. Although it is known for a spinning rotor to be formed from a plurality of components, hitherto it has always been necessary to replace the entire unit forming the spinning rotor. Thus for example, a main body is pressed onto a drive spindle and into a rotor member main body and rotor body can no longer be separated from each other (DOS No. 20 58 340).

Of course, it has also already been proposed that only a slight press fit should be provided between a cylindrical main body and a rotor body which is in the form of an insert member (DOS No. 21 30 582). In industrial mass production, the precise tolerances required cannot be readily maintained; in one case, there is the danger that the pressing is at such a high value that, when the rotor body is replaced, the main body also suffers wear which results in excessive play which in time does not insure that the rotor body is securely held in the main body. In the other situation, there is the danger that the play between the rotor body and the main body is excessive from the outset so that the rotor body is not securely held in the main body from the beginning. Moreover, since the main body extends over the entire axial extent of the rotor body, this results in an increase in the weight of the spinning rotor, thus requiring a higher drive power.

The problem of the present invention is therefore to provide a composite spinning rotor which on the one hand permits ease of replaceability of the component which is subjected to wear and which on the other hand permits relatively large tolerances without a substantial increase in the weight of the spinning rotor.

SUMMARY OF THE INVENTION

According to the invention, this problem is solved in that the centering surfaces in the main body and in the rotor body are in the form of a peripheral groove and a peripheral rib, respectively, and the support surface and the centering surface of the main body have substantially radial slots. By virtue of the slots, the support surface is resilient and receives the rotor body, by way of the centering surfaces, not by a press fit but by a clamping action. This permits the rotor body to be securely mounted on the main body, without excessive requirements having to be made in respect of tolerances. This also does not give rise to the danger of damage to or wear of the main body so that the main body has a long service life. This is particularly important as the main body generally forms a structural unit with the mounting and possibly with the drive means. Preferably, the main body has 6 to 8 slots which are of a length of from about one-fifth to one-third of the diameter of the main body.

The slots may be used for producing a reduced pressure in the spinning rotor. For this purpose, in accordance with a further feature of the invention, the bottom of the rotor body is annular and only partly covers the slots. Desirably, the slots in the main body are arranged tangentially to an imaginary concentric circle of the main body or are arranged at an inclined angle with respect to planes parallel to the axis of the main body.

If the spinning rotor is not required itself to produce a reduced pressure, then in accordance with a further feature of the invention, the rotor body advantageously has, at its end which is towards the main body, a bottom which is parallel to the support surface and which covers the slots.

The construction according to the invention is suitable not only for replacement of the rotor body in the event of wear, but it may also be used if the fiber material to be spun is changed and a spinning rotor with a different inside diameter is required. For this purpose, according to the invention, the rotor body has an inside and outside diameter adapted to the fiber material and the centering surface of the main body, irrespective of the fiber material, is of a diameter corresponding to the largest outside diameter on the rotor body, the rotor body has a flange which extends outwardly parallel to the support surface of the main body, with a center surface at its outer periphery. The centering surface of the rotor body, which, for a maximum diameter of the rotor body, is directly at the outer periphery thereof, while, for a smaller diameter of the rotor body, it is at the flange, is thus always of the same size.

For the purposes of exchanging the rotor body for another with a different inside diameter however, the rotor body may also have a projection with the centering surface, on its side which is towards the main body.

It is desirable for the rotor body to be produced in the form of a cheap throw-away member which is not only economical to manufacture but which also requires a small amount of energy for driving it. For this purpose, in accordance with a further feature of the invention, the rotor body is formed by a sheet metal member which is shaped without cutting machining. In this respect, the rotor body is produced by a deep drawing or metal pressing process, from a flat or cylindrical sheet metal component.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
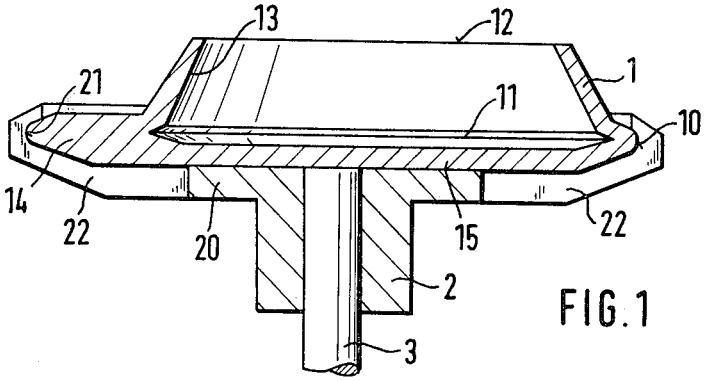
FIG. 1 shows a view in longitudinal section through an open end spinning rotor constructed in accordance with the invention, wherein the fixing of a small rotor body is shown on the left, while the fixing of a large rotor body is shown on the right, in relation to a main body which is always of the same size.

Referring to FIG. 1, the open end spinning rotor according to the invention comprises a rotor body 1, a main body 2 which carries the rotor body 1, and a mounting and drive element which carries the main body 1 and which is in the form of a shaft 3.

The rotor body 1 has a collecting surface 11 which can be in the form of a groove or a concave channel constructed in known manner, an open edge 12 at its end which is remote from the main body 2, and between the collecting surface 11 and the open edge 12, a sliding surface 13 for the fibers.

The main body 2 has a substantially radial support surface 20 with a centering surface 21 which is in the form of an inside peripheral groove at its outer periphery. The centering surface 21 thus forms a kind of channel for receiving a centering surface 10 at the outer periphery of the rotor body 1, the centering surface 10 being correspondingly formed as a peripheral rib. The main body 2 has radial slots 22 which are of such a length that they impart to the centering surface 21 such a degree of resiliency that on the one hand it can deflect radially outwardly when the rotor body 1 is pushed onto the main body 2, but on the other hand, it always remains bearing against the centering surface 10 of the rotor body 1. Thus, when the rotor body 1 comes to lie with its bottom 15 against the support 20 of the main body 2, the rotor body 1 is firmly held by way of the centering surfaces 21 and 10.

The resilient centering surface 21 of the main body 2 permits easy interchangeability of the rotor body 1, with relatively wide tolerances being permitted. Nonetheless, the weight of the spinning rotor is not substantially increased.

The rotor body 1 may be of different profiles, surfaces and inside diameter. With a change of material or even after wear, it is readily possible for the rotor body 1 to be replaced independently of the main body 2. For this purpose it is only necessary to apply a pulling force in order to pull the rotor body 1 with its centering surface 10 out of the centering surface 21 which, when this is done, yields resiliently and temporarily deflects radially outwardly.

If another fiber length is to be spun, another rotor diameter is required. So that the entire rotor does not have to be replaced in this case, for which purpose the main bodies 2 would also have to be held in store, the rotor body 1 may have a uniform outside diameter in respect of its centering surface 10, even if the diameter of its collecting surface 11 varies. For this purpose, the smaller rotor body 1 shown on the left-hand side of FIG. 1 has a flange 14 which extends outwardly parallel to the support surface 20 of the main body 2 and whose outer periphery is formed as the centering surface 10. The dimensions of the main body 2 are matched to the largest rotor body 1 which is likely to be used and which does not have a flange 14 as referred to above, but instead its outer periphery is directly formed as the centering surface 10. Thus, depending on the diameter of their collecting surfaces 11, only the smaller rotor bodies 1 have a flange 14 of different sizes, which the outer periphery of the respective flanges always being of the same size and being formed as the centering surface 20. In this case, storage is restricted only to the rotor bodies of different sizes.

The rotor body 1 shown in FIG. 1 is produced by a cutting machining production process. In order to obtain a rotor body 4 which is of particularly small mass, the rotor body may also be in the form of a sheet metal component which is shaped without machining cutting, as shown in FIG. 2.

The design of the mounting and drive element is also of no account from the point of view of the present invention. Thus, instead of the main body being connected to the shaft, the main body 5 may be formed integrally with a sleeve 50 which on its inside wall carries permanent magnets 51 which, in turn, are part of an electric motor. For mounting purposes, a mounting trunnion 53 which is carried by the support surface 52 of the main body 5 is disposed concentrically in the sleeve 50.

Figure 2:
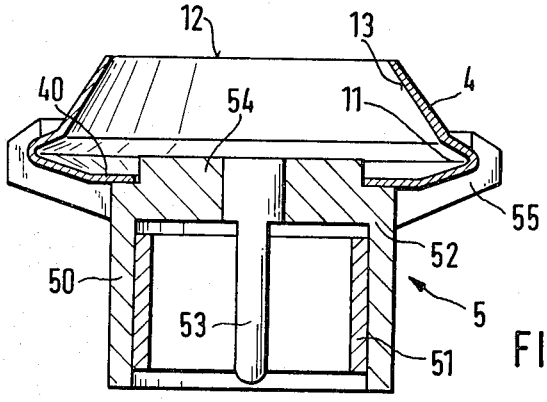
FIG. 2 shows a view in longitudinal section of a modified form of the invention.

In order to achieve the minimum size in respect of the rotor body 4 and thus the part which is to be replaced and which is to be stocked as a wearing component, the rotor body 4 is in the form of a ring with an annular bottom 40, as shown in FIG. 2. In order, with such a design, to insure that fibers do not become gripped between the rotor body 4 and the main body 5, and remain sticking there, the support surface 52 of the main body 5 in FIG. 2 has a concentric projection 54 which projects into the annular rotor body 4 and which thus projects axially above the bottom 40. If desired, the projection 54 can even project into the yarn path (not shown) between the collecting surface and the yarn take-off tube (not shown) so that the yarn is being taken off rolls against the projection 54.

Figure 3:
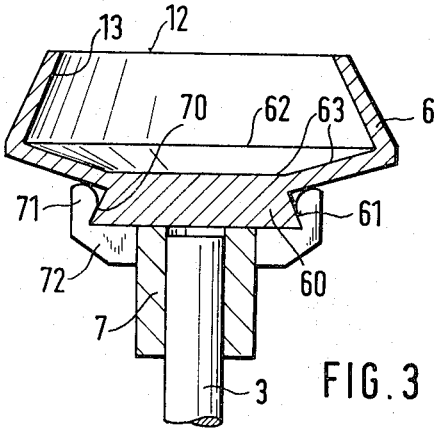
FIG. 3 shows a view in longitudinal section of a further embodiment of the spinning rotor according to the invention.

The centering surface on the rotor body may also be arranged at different positions. As shown in FIG. 3, on its side which is towards the main body, the rotor body 6 has a projection 60 with the centering surface 61 with which the centering surface 70 of the main body 7 cooperates. In this construction, the main body 7 is very small and permits the replacement of rotor bodies 6 with different diameters in respect of their collecting surface 62.

The shape of the annular centering surfaces on the rotor body 1, 4 or 6 and on the main body 2, 5 and 7 is of no importance in itself; it is simply necessary for the centering surfaces to be matched to each other. Thus, the hollow channel-like centering surface 21 for example has a curved concave cross-section while the channel-like centering surface 70 has an acute-angled cross-section which merges into a convex configuration. The centering surface 10 which is in the form of an annular rib has a convex cross-section while the centering surface 61 is of an acute-angled cross-section. It is also possible for the centering surface of the rotor body 1, 4 or 6 to be formed in the manner of a channel into which a rib-like centering surface of the main body 2, 5, 7, 8 or 9 then engages.

It has been found that, depending on the design and the size of the main body 2, 5, or 7, it is advantageous for the slots 22, 55 or 71, respectively, to be of a length which approximately corresponds to from one-fifth to one-third of the diameter of the main body 2, 5 or 7, respectively. Depending on the size of the main body 2, 5 or 7, the desired degree of resiliency of the support surface 20, 52 or 72, respectively, is obtained by from 6 to 8 slots which project in a uniformly distributed arrangement from the outside into the support surface 20, 52 and 72, respectively.

Referring to FIGS. 1 to 3, the rotor body 1, 4 and 6 has a bottom 15, 40 and 63 which is parallel to the respective support surface 20, 52 and 72 and which covers the slots 22, 55 and 71 in the main body 2, 5 and 7, respectively. This presupposes that the reduced pressure in the spinning rotor, which is required for conveying the fibers into the spinning rotor, is produced by an outside reduced-pressure source. This is frequently desirable as the spinning suction is then independent of the speed of rotation of the spinning rotor. In practice however, many rotors will also be encountered, which produce the spinning suction themselves so that the outside reduced-pressure source can be omitted. In this case, the slots 22, 55 and 71 are not covered by the bottom of the rotory body 1, 4 and 6, respectively, but on the contrary, the bottom is then only of an annular configuration.

Figure 4:
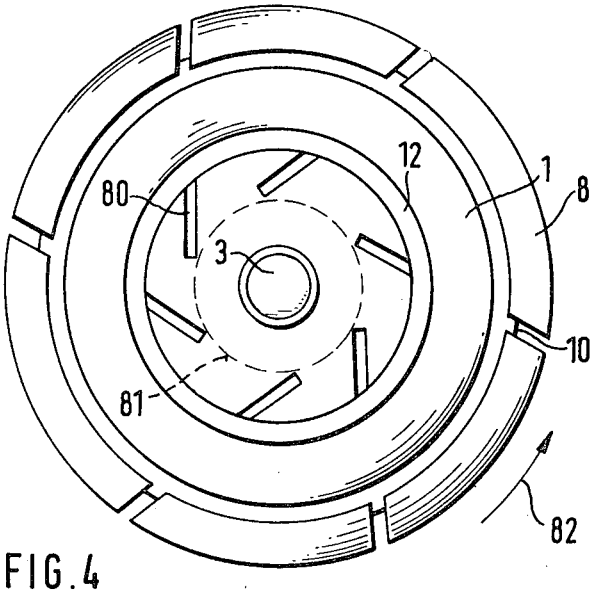
FIG. 4 shows a plan view of a spinning rotor designed in accordance with the invention, with slots which serve to produce a reduced pressure.

An embodiment of the spinning rotor according to the invention, of this kind, is shown in FIG. 4. In this arrangement, the main body 8 has slots 80 which project to beyond the inside edge of the bottom 40 (see FIG. 2). In order further to increase the fan effect, the slots 80 can be arranged tangentially with respect to an imaginary concentric circle 81 on the main body 8, in such a way that, in relation to the intended direction of rotation 82 of the spinning rotor, the outer end of the slots 80 trails their inner end.

Figure 5:
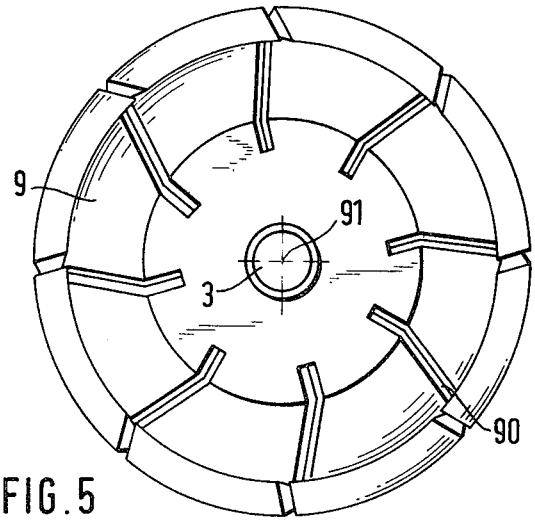
FIG. 5 shows a plan view of a main body with slots which serve to produce a reduced pressure.

An alernative way of producing a strong spinning suction as a result of the rotary movement of the spinning rotor is shown in FIG. 5 which illustrates a main body 9. In this embodiment, the slots 90 are arranged at an inclined angle with respect to planes which extend parallel to the axis 91 on the main body 9, in such a way that the ends of the slots 90 which are remote from the rotor body 1, 4 and 6, respectively, trail with respect to the ends of the slots 90 which are towards the rotor body 1, 4 and 6.

When the slots 80 or 90 are arranged as shown in FIGS. 4 and 5, the slots 80 and 90 increase the suction action in the interior of the rotor body 1, 4 and 6 so that a particularly high suction is produced, in relation to the speed of rotation. If a lower suction force is required, it is sufficient to provide slots which extend parallel to the axis 91 of the main body 9.

The construction in the form of a composite rotor with a main body 3 which is always of the same size, and rotor bodies 4 which are of different sizes and which are adapted to the main body 3 by means of a flange 46, can be used independently of the specific nature of the connection between the main body 3 and the rotor body 4. In this connection, other forms of fixing action which are not described herein can be employed.

The foregoing description shows that the subject of the invention can be modified in many ways. Further modifications by the replacement of features by equivalents or by combinations of features are possible.

What is claimed is:

1. An open end spinning rotor which comprises a main body and a rotor body and the main body of which is carried by a mounting and drive element and has a substantially radial support surface with a centering surface at its outer edge, a centering surface of the rotor body cooperating with the centering surface of the main body, a collecting surface being provided in said rotor body and an open edge remote from said centering surface, comprising: said centering surfaces (21, 70) in the main body (2, 5, 7, 8, 9) and in the rotor body (1, 4, 6) are in the form of a peripheral groove and a peripheral rib, respectively, and said support surface (20, 52, 72) and the centering surfaces (21, 70) of said main body (2, 5, 7, 8, 9) have substantially radial slots (22, 55, 71, 80, 90).

2. A spinning rotor according to claim 1 further comprising:

said slots (22, 55, 71, 80, 90) having a length of about one-fifth to one-third of the diameter of said main body (2, 5, 6, 8, 9).

3. A spinning rotor according to claim 1 further comprising:

from six to eight slots (22, 55, 71, 80, 90) provided in said main body.

4. A spinning rotor according to claim 1 further comprising:

a bottom (40) of the rotor body (1, 4) being annular and only partly covering said slots (80, 90).

5. A spinning rotor according to claim 4 further comprising:

said slots (80) in the main body (8) are arranged tangentially to a concentric imaginary circle (81) of the main body (8).

6. A spinning rotor according to claim 4 further comprising:

said slots (90) arranged at an inclined angle with respect to planes parallel to the axis (91) of the main body (9).

7. A spinning rotor according to claim 1 further comprising:

said rotor body (1, 4, 6) having at its end which is towards said main body (2, 5, 7), a bottom (15, 40, 63) which is parallel to the support surface (20, 52, 72) and which covers said slots (22, 52, 71).

8. A spinning rotor according to claim 1 further comprising:

a projection (60) carried on a side of said rotor body (6) adjacent said main body (7), said centering surface (61) being provided on said projection.

9. A spinning rotor according to claim 1 further comprising:

said rotor body being constructed of sheet metal.

10. An open end spinning rotor comprising:

a rotor body; and a main body;

said rotor body including;

(i) a spinning chamber provided with a collecting surface and an open edge, (ii) a radially extending flange, (iii) a centering surface carried on an outer periphery of said flange, said main body including;

(i) a radially extending support surface for supporting said rotor body, (ii) a centering surface (31) carried on an outer periphery of said support surface for engaging said centering surface carried on said outer periphery of said flange of said rotor body, and (iii) radial slots provided in said centering surface 31 and said support surface permitting said centering surface 31 and said support surface to be expanded for ready insertion and removal of said rotor body.

* * * * *